US007862482B1

(12) United States Patent
Hsu

(10) Patent No.: US 7,862,482 B1
(45) Date of Patent: Jan. 4, 2011

(54) ADJUSTABLE ELLIPTICAL TRAINER

(76) Inventor: Kuan-Yung Hsu, No. 38, Huiwen 3 St., Hsitun Dist., Taichung (TW)

( * ) Notice: Subject to any disclaimer, the term of this patent is extended or adjusted under 35 U.S.C. 154(b) by 0 days.

(21) Appl. No.: 12/654,638

(22) Filed: Dec. 28, 2009

(30) Foreign Application Priority Data

Nov. 12, 2009 (TW) ..... 98220989 U

(51) Int. Cl.
*A63B 22/00* (2006.01)
*A63B 22/04* (2006.01)

(52) U.S. Cl. ..... 482/52; 482/51; 482/57

(58) Field of Classification Search ..... 482/51, 482/52, 53, 57, 62, 70, 71, 79, 80; 434/247, 434/255; D21/668, 670
See application file for complete search history.

(56) References Cited

U.S. PATENT DOCUMENTS 5,911,649 A * 6/1999 Miller ..... 482/52
6,024,676 A * 2/2000 Eschenbach ..... 482/51
6,045,487 A * 4/2000 Miller ..... 482/52
6,994,657 B1 * 2/2006 Eschenbach ..... 482/52
7,455,624 B2 * 11/2008 Liao Lai ..... 482/52
7,485,072 B2 * 2/2009 Chuang et al. ..... 482/52
7,556,591 B2 * 7/2009 Chuang et al. ..... 482/52
7,608,018 B2 * 10/2009 Chuang et al. ..... 482/52
7,611,446 B2 * 11/2009 Chuang et al. ..... 482/52
7,618,351 B2 * 11/2009 Kwon et al. ..... 482/52
7,651,445 B1 * 1/2010 Chen ..... 482/52
2006/0223678 A1 * 10/2006 MacLean ..... 482/51
2008/0261778 A1 * 10/2008 Chuang et al. ..... 482/52
2008/0261779 A1 * 10/2008 Chuang et al. ..... 482/52
2009/0011904 A1 * 1/2009 Chuang et al. ..... 482/52

* cited by examiner

*Primary Examiner*—Loan Thanh
*Assistant Examiner*—Daniel F Roland
(74) *Attorney, Agent, or Firm*—Bacon & Thomas, PLLC

(57) ABSTRACT

The adjustable elliptical trainer has a base, a transmitting wheel, two link assemblies and two pedals. The base has a wheel frame mounted on the base and having a fulcrum shaft on a top end of the wheel frame. The transmitting wheel is mounted rotatably on the wheel frame and has a transmitting shaft and two transmitting levers. The transmitting levers are respectively mounted radially on the transmitting shaft and extend in two opposite directions. The link assemblies are respectively set on two sides of the base, and each has multiple levers and an adjusting element. The levers are mounted pivotally on the fulcrum shaft and the transmitting lever to rotate the transmitting wheel. The adjusting element is mounted on the levers and is adjusted to change an orbit of the elliptical trainer. The pedals are respectively mounted on the link assemblies.

10 Claims, 8 Drawing Sheets

ADJUSTABLE ELLIPTICAL TRAINER

BACKGROUND OF THE INVENTION

1. Field of the Invention

The present invention relates to an adjustable elliptical trainer with an adjustable link to provide an adjustable stepping function for improved user comfort.

2. Description of Related Art

A conventional elliptical trainer has a base, a resisting wheel, two link assemblies and two pedals. The base is set on the floor and has a front end, a rear end, a centerline, a fixed frame, and a wheel frame. The centerline is defined from the front end to the rear end and divides the base into two segments symmetrically. The fixed frame is mounted on the front end of the base on the centerline. The wheel frame is mounted on the rear end of the base on the centerline. The resisting wheel is rotatably mounted on the wheel frame and has a rotating shaft.

The link assemblies are respectively set on the segments of the base and are divided from the centerline, and each has a swinging lever, a pedal lever and a rotating lever. The swinging lever is mounted pivotally on the fixed frame and has a top end, a bottom end and a grip. The grip is mounted on the top end of the swinging lever. The pedal lever has a front end and a rear end. The front end of the pedal lever is mounted pivotally on the bottom end of the swinging lever. The rotating lever has a first end and a second end. The first end of the rotating lever is mounted pivotally on the rear end of the pedal lever. The second end of the rotating lever is mounted on the rotating shaft of the resisting wheel. The pedals are respectively mounted on the pedal levers of the link assemblies.

The user holds the grips of the swinging levers and steps on the pedals, and drives the link assemblies to rotate the resisting wheel for exercise or training.

However, the levers of the conventional elliptical trainer have fixed pivots, so the stepping travel of the conventional trainer is fixed and unchangeable. The conventional elliptical trainer cannot be adjusted for different users. The pedals are respectively mounted on the pedal levers and cannot pivot at an adjustable angle relative to the pedal levers. Therefore, the pedals of the conventional elliptical trainer may cause discomfort to the user.

To overcome the shortcomings, the present invention tends to provide an adjustable elliptical trainer to mitigate or obviate the aforementioned problems.

SUMMARY OF THE INVENTION

The main objective of the present invention is to provide an adjustable elliptical trainer with an adjustable element to provide a step adjustable function and adapt to the different user.

The adjustable elliptical trainer has a base, a transmitting wheel, two link assemblies and two pedals. The base has a wheel frame mounted on the base and having a fulcrum shaft on a top end of the wheel frame. The transmitting wheel is mounted rotatably on the wheel frame and has a transmitting shaft and two transmitting levers. The transmitting levers are respectively mounted radially on the transmitting shaft and extend in two opposite directions. The link assemblies are respectively set on two sides of the base, and each has multiple levers and an adjusting element. The levers are mounted pivotally on the fulcrum shaft and the transmitting lever to rotate the transmitting wheel. The adjusting element is mounted on the levers and is adjusted to change an orbit of the elliptical trainer. The pedals are respectively mounted on the link assemblies.

Other objects, advantages and novel features of the invention will become more apparent from the following detailed description when taken in junction with the accompanying drawings.

DETAILED DESCRIPTION OF PREFERRED EMBODIMENT

Figure 1:
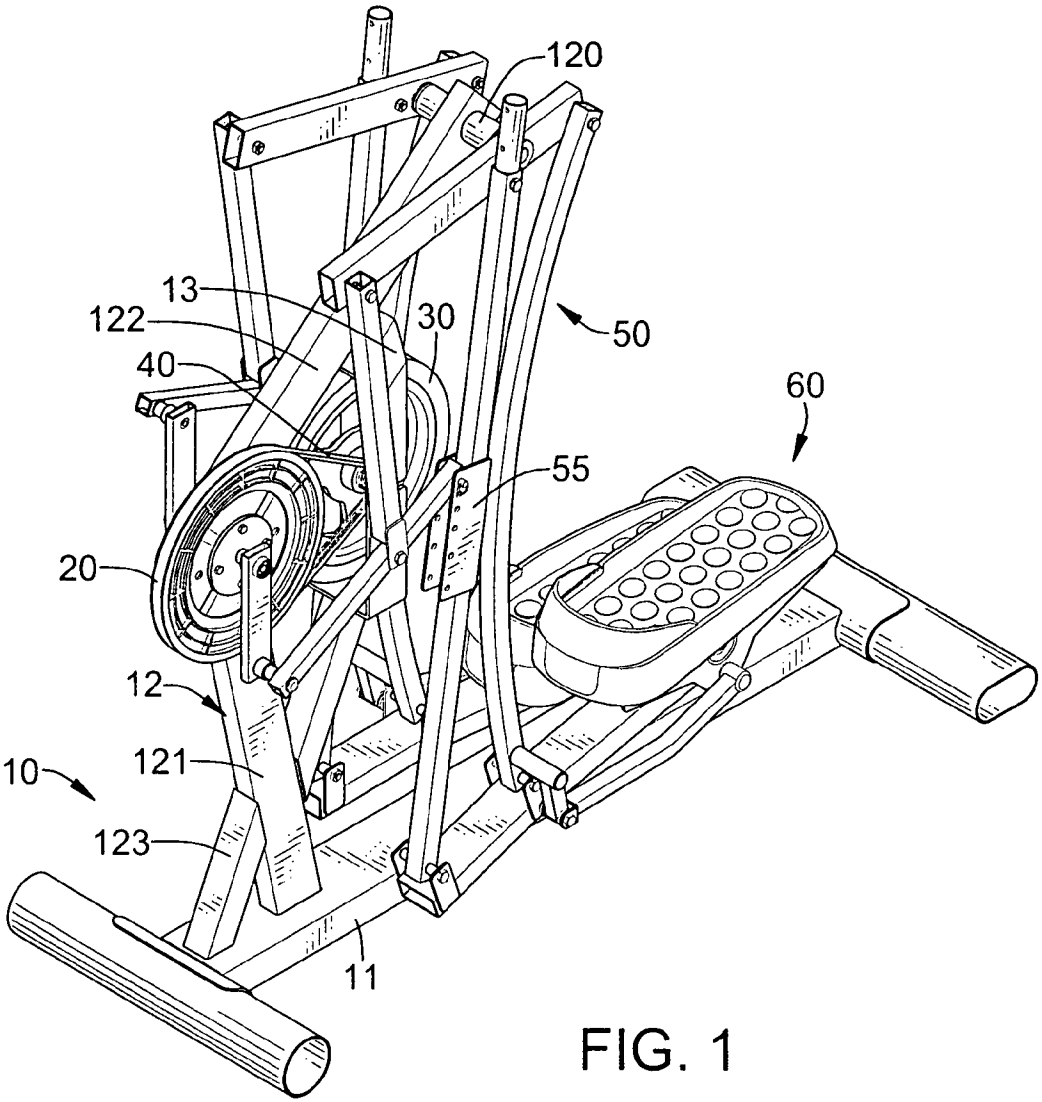
FIG. 1 is a perspective view of an adjustable elliptical trainer in accordance with the present invention.
Figure 2:
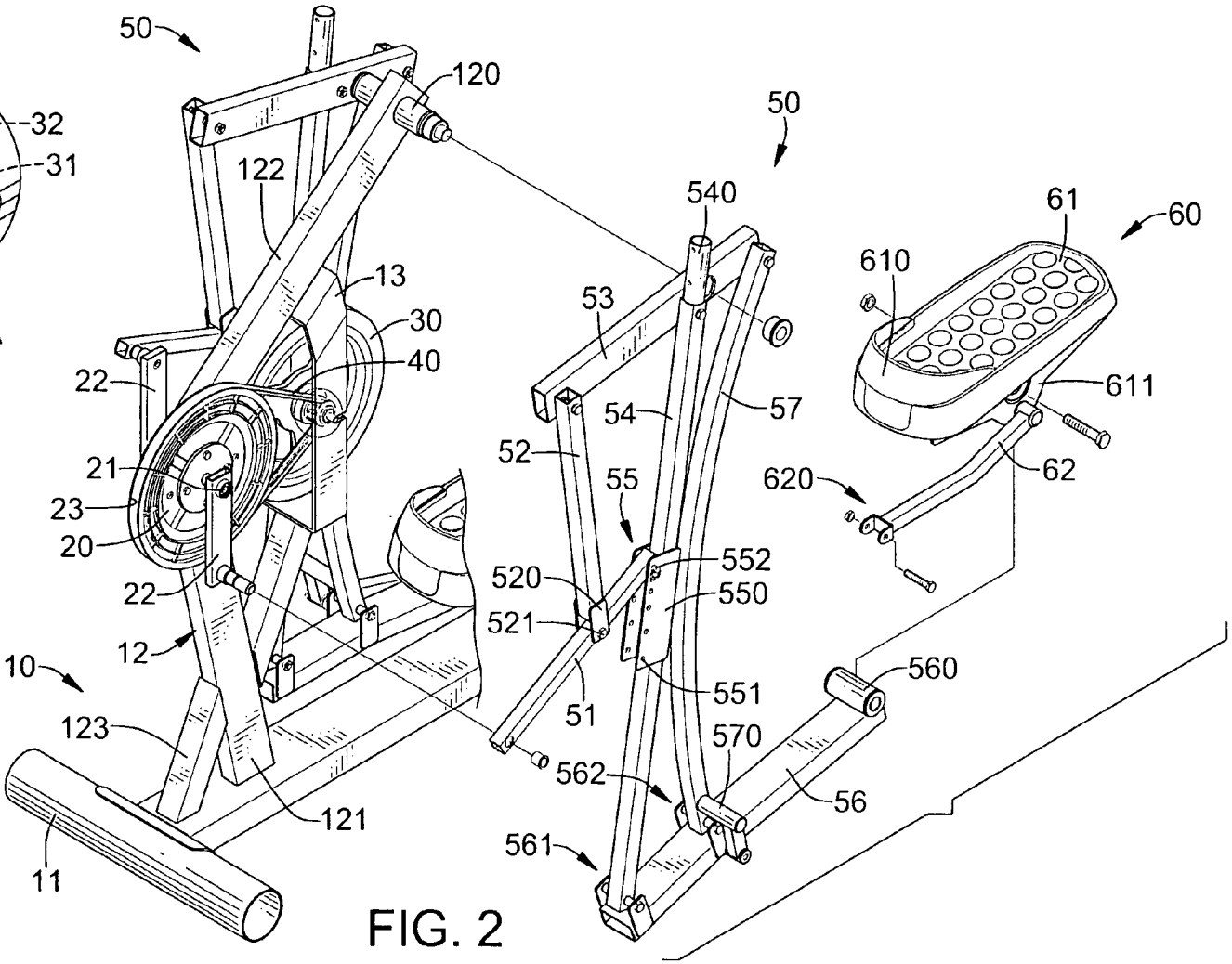
FIG. 2 is a partially exploded perspective view of the elliptical trainer in FIG. 1.
Figure 2A:
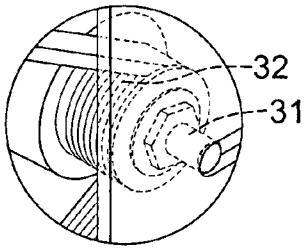
FIG. 2A is an enlarged perspective view of a resisting shaft of a resisting wheel of the elliptical trainer in FIG. 2.
Figure 3:
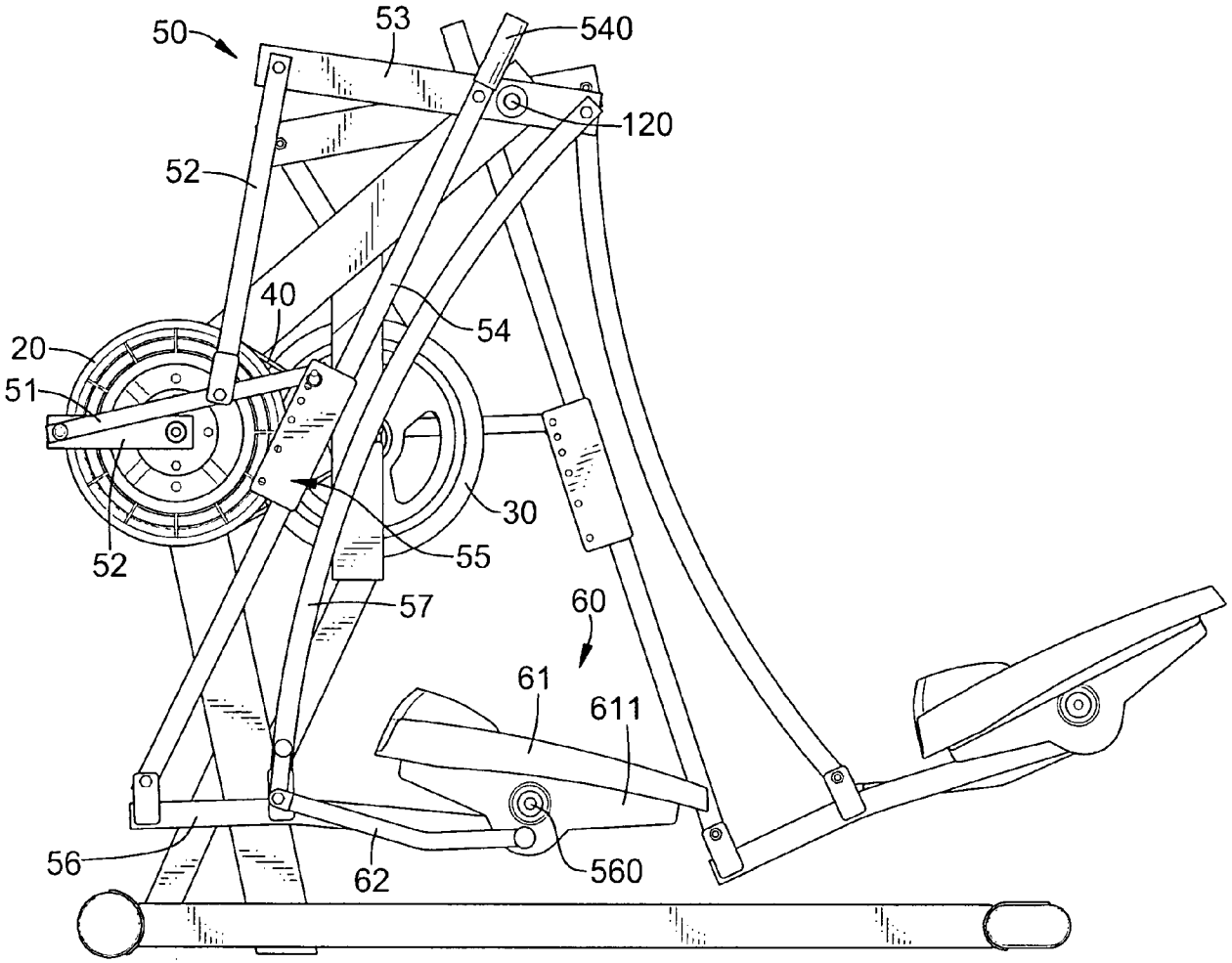
FIGS. 3 to 6 are a series of operational side views of the elliptical trainer in FIG. 1, shown adjusted to a longer stride.
Figure 4:
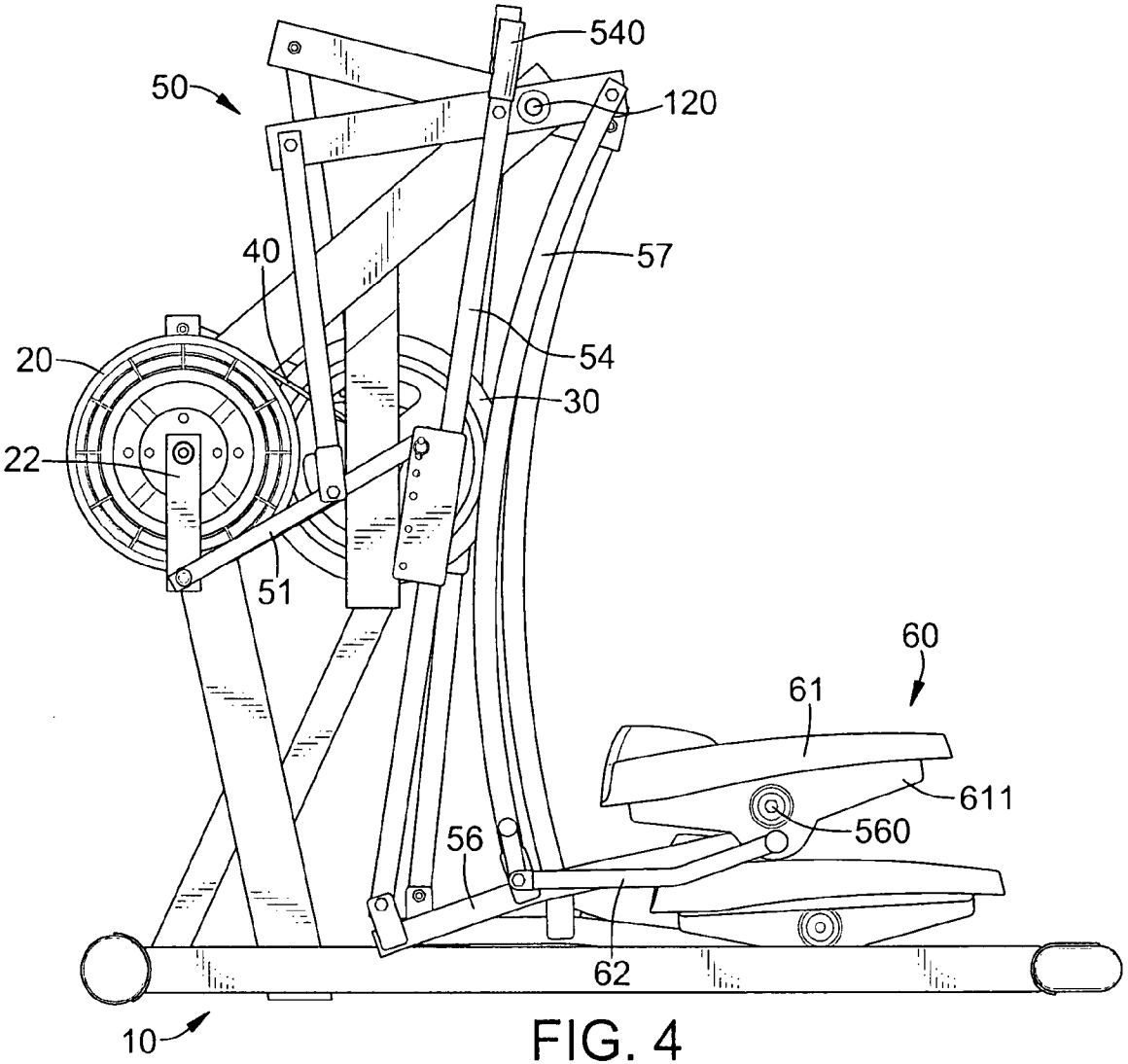
Figure 5:
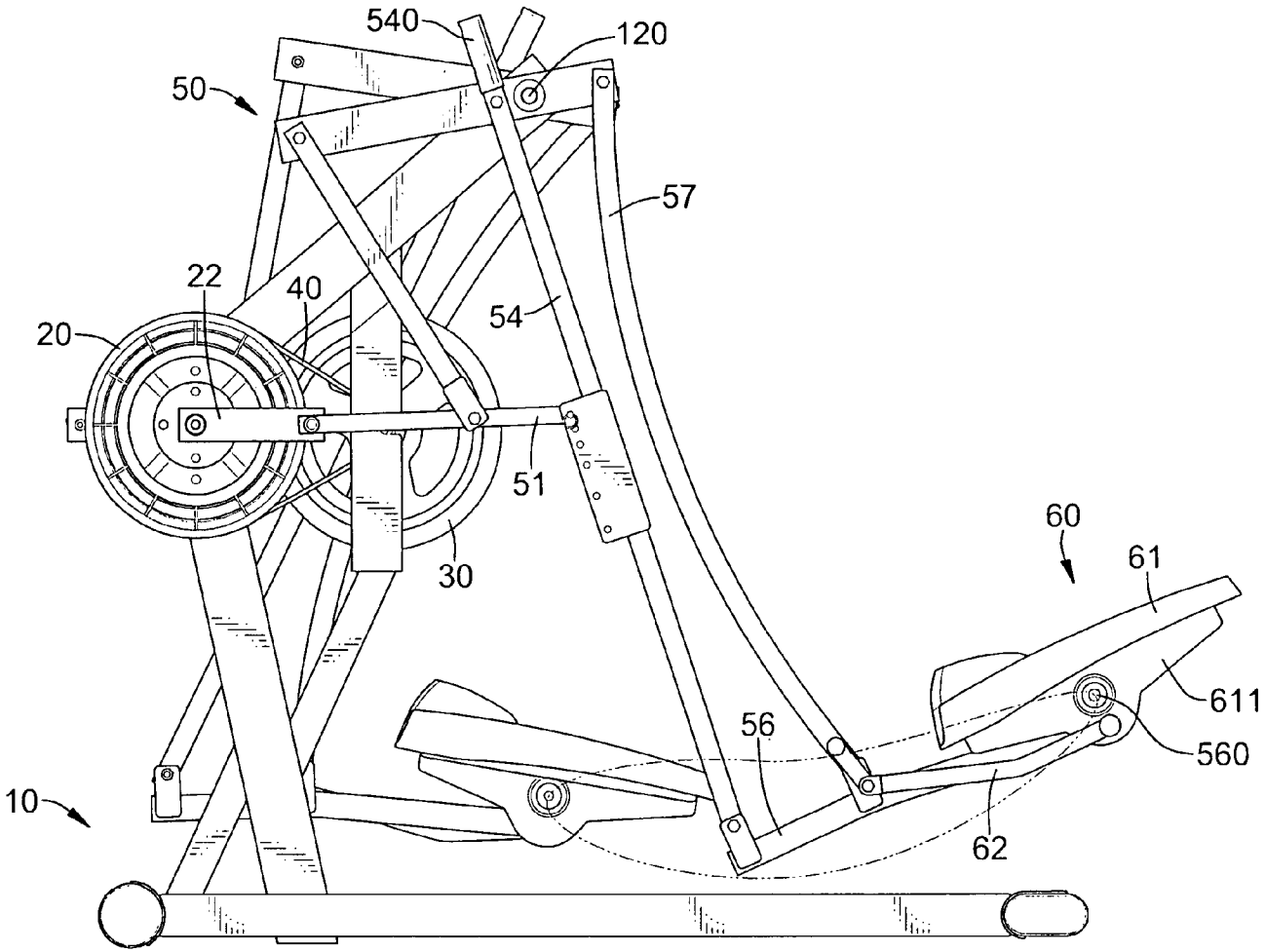
Figure 6:
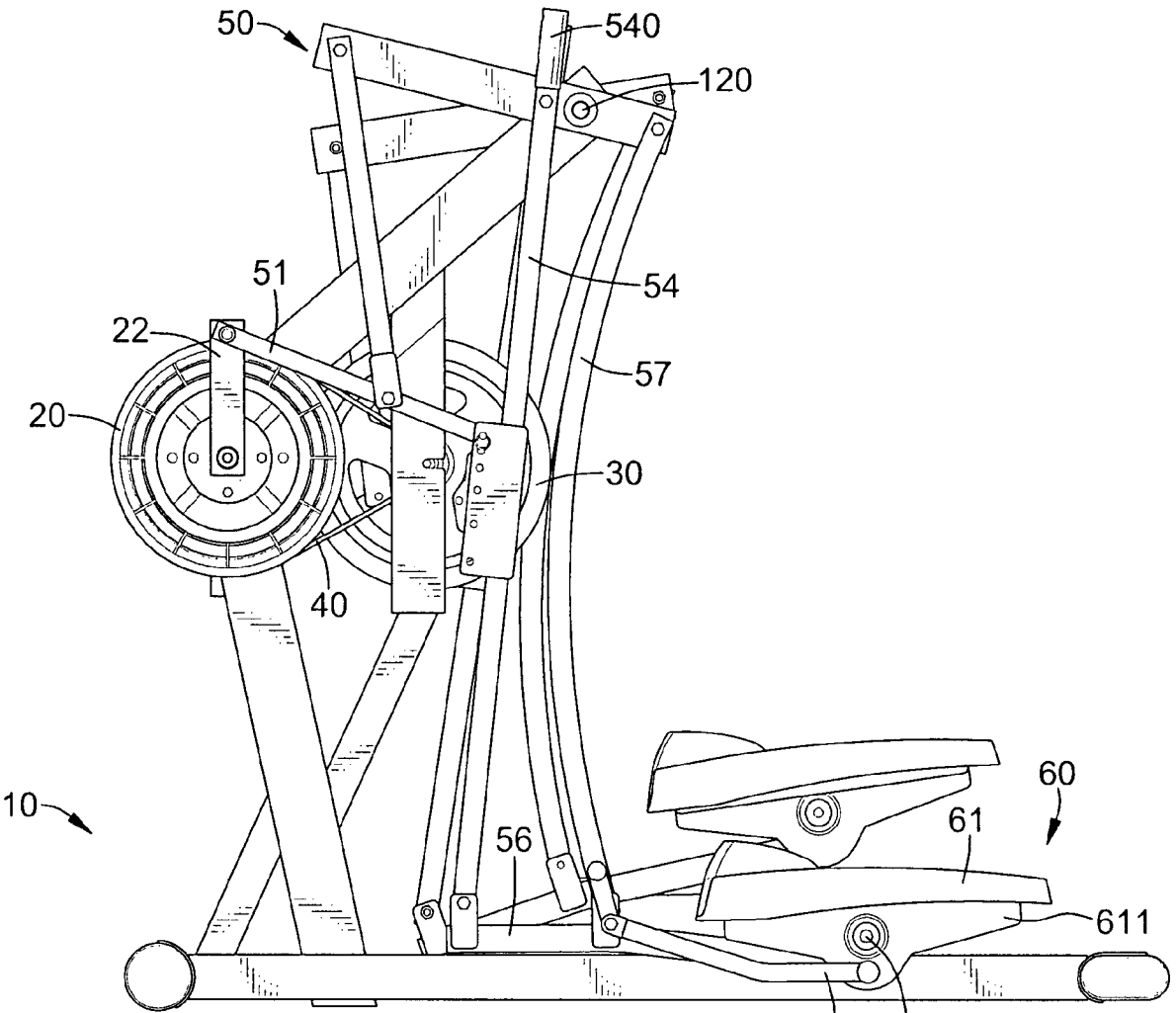

With reference to FIGS. 1 to 3, an elliptical trainer in accordance with the present invention has a base (10), a transmitting wheel (20), a resisting wheel (30), a transmitting belt (40), two link assemblies (50) and two pedals (60). The base (10) has a bottom frame (11), a wheel frame (12) and a setting frame (13).

The bottom frame (11) is set on the floor and has a front end, a rear end and a centerline. The centerline is defined from the front end to the rear end of the bottom frame (11) to divide the bottom frame (11) of the base (10) into two segments symmetrically. The wheel frame (12) is mounted on the front end of the bottom frame (11) on the centerline, and has a bottom pillar (121), an upper pillar (122), a junction part, a shaft hole, a fulcrum shaft (120) and an optional supporting pillar (123). The bottom pillar (121) is mounted on and protrudes upward from and toward the front end of the bottom frame (11). The upper pillar (122) is mounted on the bottom pillar (121), and protrudes toward the rear end of the bottom frame (11) and has a top end. The junction part is defined between the bottom pillar (121) and the upper pillar (122).

The shaft hole is formed through the junction part of the wheel frame (12). The fulcrum shaft (120) is mounted rotatably through the top end of the upper pillar. The supporting pillar (23) is mounted on the bottom pillar (121) and the front end of the bottom frame (11). The setting frame (13) is mounted on the upper pillar (122) toward the bottom pillar (121) and has a quadrilateral cross section and two side boards.

The transmitting wheel (20) is rotatably mounted on the wheel frame (11) and has a transmitting shaft (21), two transmitting levers (22), a periphery surface and a belt recess (23). The transmitting shaft (21) is mounted through the shaft hole of the wheel frame (12) and has two outer ends. The transmitting levers (22) are respectively mounted radially on the outer ends of the transmitting shaft (21), respectively extend in two opposite directions and each transmitting lever (22) has a connecting end. The periphery surface is defined around the transmitting wheel (20). The belt recess (23) is formed in the periphery surface of the transmitting wheel (20).

The resisting wheel (30) is mounted rotatably on the setting frame (13), and has a resisting shaft (31) and a belt groove (32). The resisting shaft (31) has two ends respectively mounted through the side boards of the setting frame (13). The belt groove (32) is formed around one end of the resisting shaft (31), and corresponds to and aligns with the belt recess (23) of the transmitting wheel (20). The transmitting belt (40) is annular and mounted in the belt recess (23) of the transmitting wheel (20) and the belt groove (32) of the resisting wheel (30) to drive the resisting wheel (30) to rotate by the transmitting wheel (20).

The link assemblies (50) are respectively set on two sides of the base (10), are symmetrical to the centerline of the bottom frame (11) and are mounted pivotally on the transmitting levers (22) and the fulcrum shaft (120), and each link assembly (50) has a bottom lever (51), a front lever (52), an upper lever (53), a rear lever (54), an adjusting element (55), a pedal lever (56) and a swinging lever (57).

The bottom lever (51) has a front end, a rear end and a middle part. The front end of the bottom lever (51) is mounted pivotally on the outer end of the transmitting lever (22). The rear end of the bottom lever (51) has an inserting hole. The middle part is defined between the front end and the rear end of the bottom lever (51). The front lever (52) has a bottom end, a top end, two optional tabs (520) and an optional pin (521). The bottom end of the front lever (52) is mounted pivotally on the middle part of the bottom lever (51). The tabs are parallel to each other, protrude from the bottom end of the front lever (52), and are mounted on the middle part of the bottom lever (51). The pin is inserted through the tabs and the bottom lever (51) to pivotally connect the front lever (52) with the bottom lever (51).

The upper lever (53) has a front end, a rear end and a fulcrum part. The front end of the upper lever (53) is mounted pivotally on the top end of the front lever (52). The fulcrum part is defined near the rear end of the upper lever (53) and is mounted rotatably on the fulcrum shaft (120).

The rear lever (54) has a top end, a bottom end, an adjusting element (55) and a grip (540). The top end of the rear lever (54) is mounted pivotally on the upper lever (53) between the front end and the fulcrum part of the upper lever (53). The adjusting element (55) is mounted on the rear lever (54) between the top end and the bottom end of the rear lever (54), and connects to the rear end of the bottom lever (51) to allow the bottom lever (51) to be adjusted along a line parallel with the rear lever (54). The grip (540) is mounted on the top end of the rear lever (54).

The adjusting element (55) may be a manual type or automatic type. The manual type of the adjusting element (55) has two boards (550) and a pivoting pin (552). The boards (550) are parallel to each other and mounted on the rear lever (54) between the top end and the bottom end of the rear lever (54) and adjustably connected to the rear end of the bottom lever (51), and each board (550) has multiple adjusting holes (551). The adjusting holes (551) are formed through the board (550), are arranged in a line parallel with the rear lever (54), and selectively align with the inserting hole on the rear end of the bottom lever (51). The adjusting holes (511) of each board (550) correspond to and align respectively with the adjusting holes (511) in the other board (550). The pivoting pin (552) is inserted through the aligned adjusting holes (551) of the boards (550) and the inserting hole of the bottom lever (51).

The automatic type of the adjusting element (55) has a board, a connector and a motor. The board is mounted on the rear lever (54) between the top end and the rear end of the rear lever (54) and has a channel formed along a line parallel with the rear lever (54). The connector is slidably mounted in the channel of the board and mounted on the rear end of the bottom lever (51). The motor is mounted on the board and connects to the connector to drive the connector moving along the channel and the pivoting point between the rear end of the bottom lever (51) and the adjusting element (55).

The pedal lever (56) has a front end, a rear end, a middle part and a pedal shaft (560) and two optional pivoting assemblies. One of the pivoting assembly is mounted on the front end of the pedal lever (56) and mounts the front end of the pedal lever (56) pivotally on the bottom end of the rear lever (54). The other pivoting assembly is mounted on the middle part of the pedal lever (56). Each pivoting assembly has two tabs and a pin. The tabs are parallel to each other and protrude from the pedal lever (56). The pin is mounted between the tabs. The pedal shaft (560) is transversely mounted on the rear end of the pedal lever (56).

The swinging lever (57) is curved and has a top end, a bottom end and a connecting bar (570). The top end of the swinging lever (57) is mounted pivotally on the rear end of the top lever (52). The bottom end of the swinging lever (57) is mounted pivotally on the pivoting assembly that is mounted on the middle part of the pedal lever (56). The connecting bar (570) is shaped as an inverted L and is mounted on the bottom end of the swinging lever (57).

The pedals (60) are respectively mounted on the rear end of the pedal levers (56), and each has a pedal board (61) and a guiding lever (62). The pedal board (61) has a top surface, a bottom surface, a front flange (610) and two mounting boards (611). The front flange (610) is curved and protrudes from the top surface of the pedal board (61). The mounting boards (611) protrude parallelly from the bottom surface of the pedal board (61) and connect pivotally to the pedal shaft (560). The guiding lever (62) has a front end, a rear end and a pivoting assembly (620). The pivoting assembly (620) is mounted on the front end of the guiding lever (62) and mounted pivotally on the connecting lever (570). The rear end of the guiding lever (62) is mounted pivotally on one of the mounting boards (611).

With reference to FIGS. 3 to 6, in use, the user holds the grips (520) and steps on the pedal board (61) to move the pedal levers (56) and the rear levers (54) of the link assemblies (50). The transmitting wheel (20) is driven to rotate by the link assemblies (50), and the resisting wheel (30) is rotated with the transmitting wheel (20) by the transmission of the transmitting belt (40). The resisting wheel (30) provides a resisting force to provide an exercise or training effect to the user.

In the movement of the link assemblies (50), the swinging levers (57) with the connecting levers (570) are swung to pull the guiding lever (62) to pivot the pedal board (61) relative to the pedal shaft (560). The pedals (60) may be pivoted to adapt to angle changing of the ankles of the user to prevent discomfort.

Figure 7:
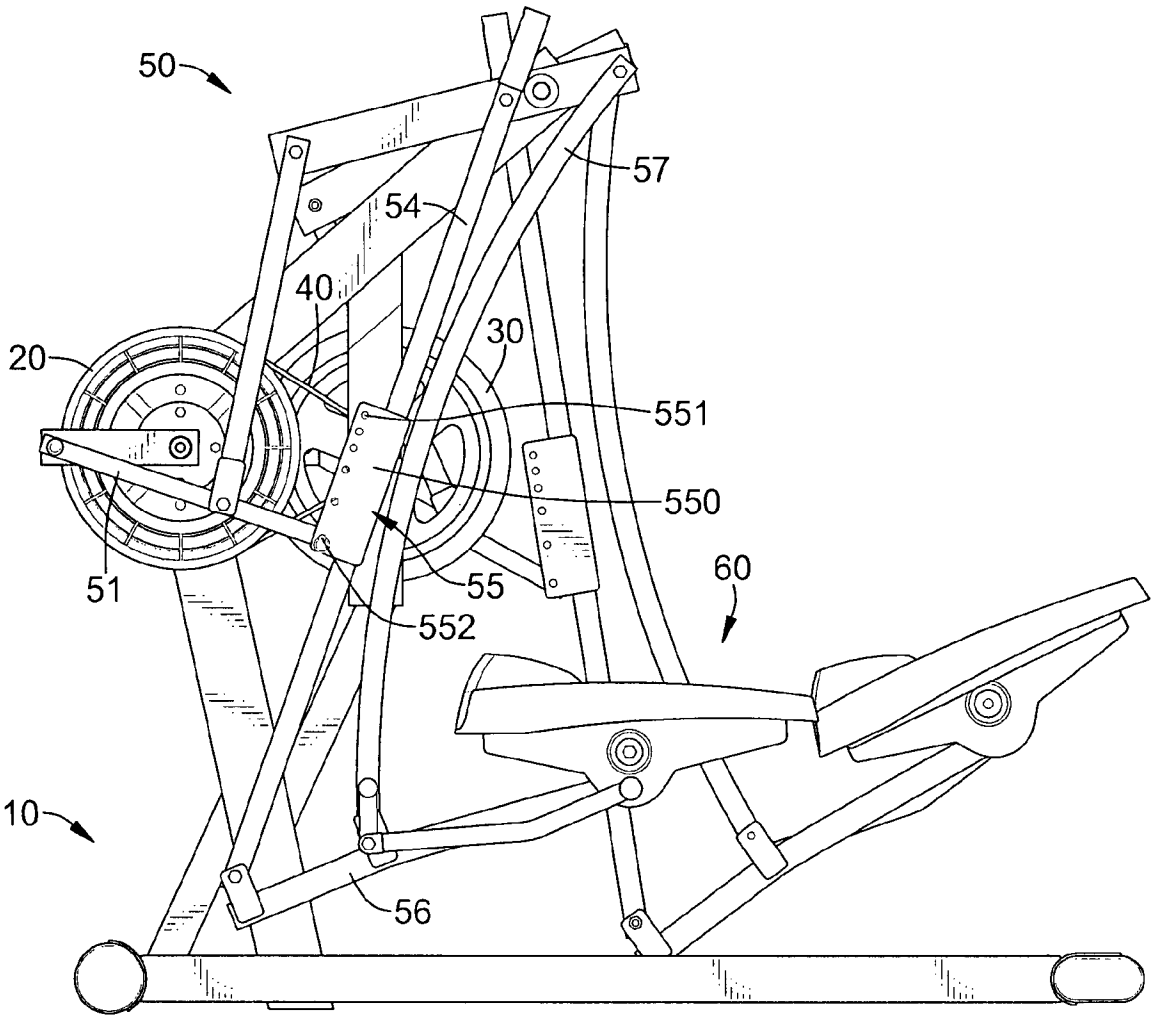
FIGS. 7 and 8 are a series of operational side views of the elliptical trainer in FIG. 1, shown adjusted to a shorter stride.
Figure 8:
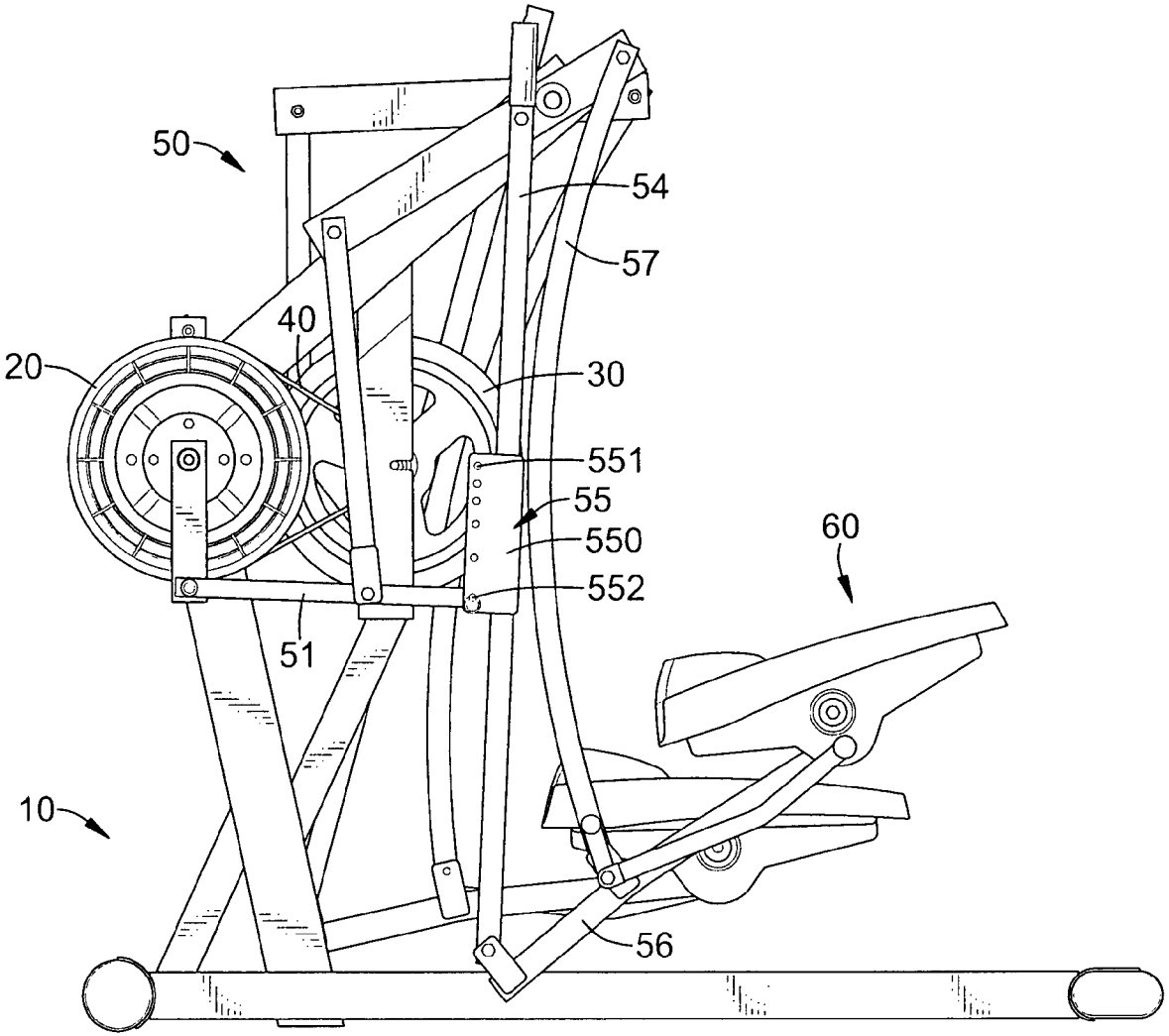

With reference to FIGS. 7 to 8, to adjust an orbit of the pedals (60) of the adjustable elliptical trainer, the rear ends of the bottom levers (51) are moved and adjusted along the line parallel with the rear levers (54) by the adjusting elements (55). With the changes of pivoting points between the rear ends of the bottom lever (51) and the rear levers (54), travel paths of the bottom ends of the rear levers (54) are also changed. Accordingly, the orbits of the pedals (60) driven by the rear levers (54) with the pedal levers (56) are accordingly changed to provide different exercise modes and fit with needs of different users.

An adjusting way in the manual type of the adjusting elements (55), the pivoting pins (552) are pulled out and released from the adjusting holes (551) of the boards (550). The rear ends of the bottom levers (51) are moved to align the inserting holes with other adjusting holes (551). The pins (552) are inserted in the corresponding inserting holes and adjusting holes (551) again to hold the bottom levers (51) at a new pivoting position relative to the rear levers (54).

An adjusting way in the automatic type of the adjusting elements (55), the motors drive the connectors moving along the channels of the boards of the adjusting elements to change the pivoting positions of the rear ends of the bottom levers (51) relative to the rear levers (54).

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. An adjustable elliptical trainer comprising: a base having a front end; a rear end; a centerline defined from the front end to the rear end to divide the base into two segments symmetrically; a wheel frame mounted on the front end of the base on the centerline and having a top end; a shaft hole formed through the wheel frame; and a fulcrum shaft mounted rotatably through the top end of the wheel frame; a transmitting wheel mounted rotatably on the base and having a transmitting shaft mounted through the shaft hole of the wheel frame and having two outer ends; and two transmitting levers respectively mounted radially on the outer ends of the transmitting shaft, and extending respectively toward two directions opposite to each other, and each having a connecting end; two link assemblies respectively set on two sides of the base, being symmetrical to the centerline, and mounted pivotally on the transmitting levers and the fulcrum shaft, and each having: a bottom lever having a front end mounted pivotally on the outer end of the transmitting lever, a rear end, and a middle part defined between the front end and the rear end of the bottom lever; a front lever having a bottom end directly mounted pivotally on the middle part of the bottom lever, and a top end; and an upper lever having a front end directly mounted pivotally on the top end of the front lever, a rear end, and a fulcrum part defined near the rear end of the upper lever and mounted rotatably on the fulcrum shaft; a rear lever having a top end directly mounted pivotally on the upper lever between the front end and the fulcrum part of the upper lever, a bottom end, and an adjusting element mounted on the rear lever between the top end and the bottom end of the rear lever, and connected to the rear end of the bottom lever, and making the bottom lever adjusting along a line parallel with the rear lever; a pedal lever having a front end mounted pivotally on the bottom end of the rear lever, a rear end, a middle part defined between the front end and the rear end of the pedal lever; and a swinging lever having a top end mounted pivotally on the rear end of the upper lever, and a bottom end mounted pivotally on the middle part of the pedal lever; and two pedals, each mounted on the rear end of the pedal lever.

2. The adjustable elliptical trainer as claimed in claim 1, wherein each bottom lever has an inserting hole formed through the rear end of the bottom lever; and each adjusting element has two boards being parallel to each other and mounted on the rear lever, and adjustably connected to the rear end of the bottom lever, and each board having multiple adjusting holes arranged in a line parallel with the rear lever, corresponding to the adjusting holes on the other board, and selectively aligning with the inserting hole; and a pivoting pin inserted through the corresponding adjusting holes and inserting hole.

3. The adjustable elliptical trainer as claimed in claim 1, wherein the transmitting wheel has a periphery surface defined around the transmitting wheel; and a belt recess formed in the periphery surface;

the base further has a setting frame mounted on the wheel frame;

a resisting wheel mounted rotatably on the setting frame, and having a resisting shaft mounted on the setting frame;

a belt groove formed around the resisting shaft, and corresponding to and aligning with the belt recess of the transmitting wheel; and a transmitting belt being annular and mounted in the belt recess of the transmitting wheel and the belt groove of the resisting wheel.

4. The adjustable elliptical trainer as claimed in claim 2, wherein the transmitting wheel has a periphery surface defined around the transmitting wheel; and a belt recess formed in the periphery surface;

the base further has a setting frame mounted on the wheel frame;

a resisting wheel mounted rotatably on the setting frame, and having a resisting shaft mounted on the setting frame;

a belt groove formed around the resisting shaft, and corresponding to and aligning with the belt recess of the transmitting wheel; and a transmitting belt being annular and mounted in the belt recess of the transmitting wheel and the belt groove of the resisting wheel.

5. The adjustable elliptical trainer as claimed in claim 1, wherein each pedal lever has a pedal shaft transversely mounted on the rear end of the pedal lever;

each pedal has a pedal board having a bottom surface; and two mounting boards protruding from the bottom surface of the pedal board, and connected pivotally to the pedal shaft;

a guiding lever having a front end mounted pivotally on the bottom end of one of the swinging levers; and a rear end mounted pivotally on one of the mounting boards.

6. The adjustable elliptical trainer as claimed in claim 2, wherein each pedal lever has a pedal shaft transversely mounted on the rear end of the pedal lever;

each pedal has a pedal board having a bottom surface; and two mounting boards protruding from the bottom surface of the pedal board, and connected pivotally to the pedal shaft;

a guiding lever having a front end mounted pivotally on the bottom end of the swinging lever; and a rear end mounted pivotally on one of the mounting boards.

7. The adjustable elliptical trainer as claimed in claim 3, wherein each pedal lever has a pedal shaft transversely mounted on the rear end of the pedal lever;

each pedal has a pedal board having a bottom surface; and two mounting boards protruding from the bottom surface of the pedal board, and connected pivotally to the pedal shaft;

a guiding lever having a front end mounted pivotally on the bottom end of the swinging lever; and a rear end mounted pivotally on one of the mounting boards.

8. The adjustable elliptical trainer as claimed in claim 1, wherein each rear lever has a grip mounted on the top end of the rear end.

9. The adjustable elliptical trainer as claimed in claim 2, wherein each rear lever has a grip mounted on the top end of the rear end.

10. The adjustable elliptical trainer as claimed in claim 5, wherein each rear lever has a grip mounted on the top end of the rear end.

* * * * *